US006463158B2

(12) United States Patent
Graf et al.

(10) Patent No.: US 6,463,158 B2
(45) Date of Patent: Oct. 8, 2002

(54) APPARATUS FOR PICKING UP SOUND WAVES

(75) Inventors: Franz Graf, Graz (AT); Martin Pflüger, Graz (AT)

(73) Assignees: Joanneum Research Forschungsgesellschaft mbH, Graz (AT); AVL List GmbH, Graz (AT)

( * ) Notice: Subject to any disclaimer, the term of this patent is extended or adjusted under 35 U.S.C. 154(b) by 0 days.

(21) Appl. No.: 09/811,770

(22) Filed: Mar. 20, 2001

(65) Prior Publication Data

US 2001/0043710 A1 Nov. 22, 2001

(30) Foreign Application Priority Data

Mar. 21, 2000 (AT) ..... 478/00

(51) Int. Cl.[7] ..... H04R 11/04
(52) U.S. Cl. ..... 381/355; 381/91; 381/361
(58) Field of Search ..... 381/91, 92, 122, 381/355, 356, 357, 358, 359, 170, FOR 147, FOR 148, 26; 181/198

(56) References Cited

U.S. PATENT DOCUMENTS 4,122,910 A * 10/1978 Wehner ..... 181/198
5,103,927 A * 4/1992 Heavener ..... 381/92

* cited by examiner

*Primary Examiner*—Huyen Le
(74) *Attorney, Agent, or Firm*—Dykema Gossett PLLC

(57) ABSTRACT

The invention relates to an apparatus for picking up sound waves with a separating body and at least two microphones arranged on the separating body. A pick-up which is particularly true to nature is achieved in such a way that the separating body consists of a reverberant material and is provided with a substantially wedge-shaped arrangement, with two separating surfaces which are inclined towards one another at an acute angle, and that the microphones are arranged at a low distance from the separating surfaces.

15 Claims, 1 Drawing Sheet

APPARATUS FOR PICKING UP SOUND WAVES

BACKGROUND OF THE INVENTION

The invention relates to an apparatus for picking up sound waves with a separating body and at least two microphones arranged on the separating body. The microphones can thereby be attached directly to the separating body or be attached together with the separating body on a joint fixing device.

In a large number of applications it is necessary to record sound signals as is received by human hearing. This relates not only to the recording and reproduction of music, but also the recording of noises in order to analyze and evaluate the same. This also forms the focus of the scope of application of the apparatus in accordance with the invention.

DESCRIPTION OF THE PRIOR ART

A known solution which allows the most genuine recording of sound signals are the so-called artificial-head systems. The human head and, partly, the human torso is reproduced as genuinely as possible, with recording microphones being arranged in the area of the ears. In this way it is possible to achieve a somewhat genuine recording of sound which is true to nature. It has been surprisingly noticed, however, that even in the case of the most careful modeling of such an artificial head it is not possible to emulate the perception of a human being in a manner that is true to nature. One of the reasons is that the specific dimensions of an artificial head concern averaged values which need not necessarily correlate to the dimensions of the hearing test person. It has been noticed in this connection that it is possible to achieve an improved representation of the original sound by using abstracted models.

SUMMARY OF THE INVENTION

It is a principal object of the present invention to provide an apparatus which allows a pick-up and recording of sound waves which is as true to nature as possible. The criterion for the quality of the representation is to be the subjective evaluation by the test persons who will determine the correlation between the original noise and the recorded and reproduced noise.

In this context, the so-called separating body stereophony is known, e.g. by using a so-called Jecklin disk. Such an apparatus consists of a circular disk of wood or plastic with a diameter of approx. 30 cm. An absorbent damping material with a thickness of approx. 10 mm to 20 mm is applied to the side surfaces. Microphones with omnidirectional characteristics are attached to both sides of the disk at a distance of approx. 16 cm from one another.

Differences in runtime and level which depend on the respective sound frequency occur during the recording of sources of sound which are situated outside of the disk plane. A recording is achieved in this way which allows a spatial localization of the source of sound during the reproduction and which is true to nature to a certain extent. In such an apparatus, however, reflections in the disk occur in a frequency range of above approx. 1 kHz with laterally impinging sound waves, with the reflected sound waves interfering with the sound waves arriving directly from the sound of source. This produces a so-called comb filter effect, which means that depending on the geometrical conditions, some frequencies are amplified and others are damped. That is why the tone color of lateral hearing events are colored and losses occur in the treble range.

It is a particular object of the present invention to further develop systems of this kind in such a way that such disadvantageous effects are avoided.

This object is achieved in accordance with the invention in such a way that the separating body consists of a reverberant material and is substantially arranged wedge-shaped, with two separating surfaces which are inclined at an acute angle to one another and that the microphones are arranged at a small distance from the separating surfaces. A small distance is designated as such which is small with respect to the wavelengths of the sound to be recorded. Since the wavelengths are approx. 17 mm at the upper limit of the range of audibility, a maximum distance of approx. 10 mm is uncritical, so that the occurrence of a comb filter effect can reliably be avoided. The advantageous aspect in the present invention is that the frontally incoming sound waves are practically not distorted. In the case of the laterally impinging sound waves, not only runtime and level differences occur, but also dynamic pressure effects, so that in conclusion it is possible to achieve a representation of the acoustic environment which is true to nature.

It has proven to be particularly advantageous that the separating surfaces are arranged substantially planarly. In this way it is possible to avoid undesirable reflections which could lead to a coloring of the sound impression. It is further advantageous if the acute angle at which the separating surfaces are inclined towards one another is between 10° and 60°, preferably between 25° and 40°. A recording can thus be achieved which is particularly true to nature.

It is provided for in a particularly preferably embodiment of the invention that the separating surfaces are provided with a substantially circular arrangement. A recording can thus be achieved which is particularly true to nature.

It is particularly favorable if the diameter of the separating surfaces is between 18 cm and 35 cm. This corresponds approximately to the size of the human head. An acoustically particularly favorable solution is given when the distance of the separating surfaces is at the points of closest approach between 10% and 30% of the diameter of the separating surfaces.

Diffraction effects can be avoided in particular in such a way that the separating surfaces are formed in an integral manner with a circular-cylindrical housing which is rounded off in the transition area to the separating surfaces.

It is principally possible to arrange the separating body as a solid body. As an alternative, however, it is also possible to provide that the apparatus is arranged as a shell body which is hollow in the interior. A low weight can thus be achieved.

Special acoustic advantages are further obtained when the microphones are arranged outside of the mid-points of the separating surfaces. In particular, it is favorable in this connection when the microphones are attached to points of the separating surfaces which are provided with a larger distance than the midpoints of the separating surfaces. It is particularly advantageous when the separating surfaces are provided with a circular arrangement and that the microphones are arranged at a distance from the mid-point of the separating surfaces which is between 10% and 50%, preferably between 20% and 40% of the diameter of the separating surfaces.

A reproduction of frontally impinging sound waves which is particularly true to nature can be achieved when the microphones are provided with omnidirectional characteristics.

BRIEF DESCRIPTION OF THE DRAWINGS

The present invention is now explained in closer detail by reference to the embodiments shown in the drawings, wherein.

DETAILED DESCRIPTION OF THE PREFERRED EMBODIMENTS

Figure 1:
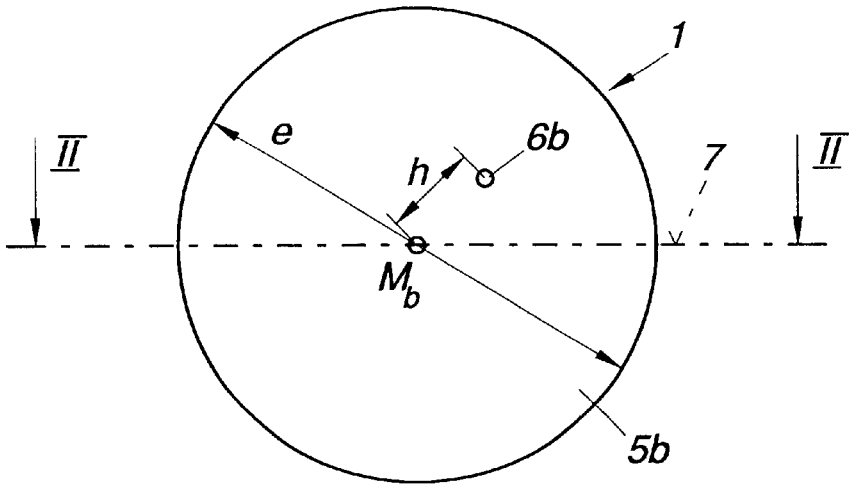
FIG. 1 shows a side view of an apparatus in accordance with the invention and FIG. 2 shows a sectional view according to line II—II in FIG. 1.
Figure 2:
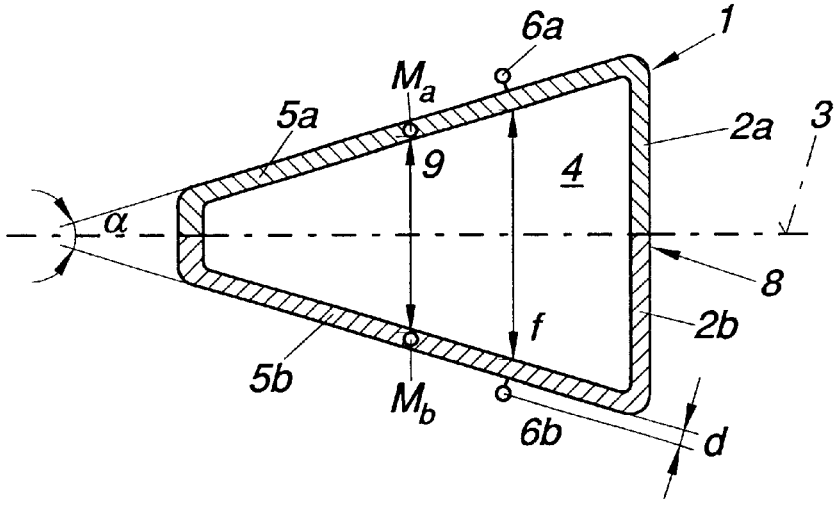

The apparatus in accordance with the invention consists of a separating body 1 which is composed of two shells 2*a*, 2*b* which are arranged symmetrically to a plane of symmetry 3. The interior space 4 of the separating body 1 is hollow, but can also be filled with a suitable damping material. The separating body 1 comprises two separating surfaces 5*a*, 5*b* which are inclined at an angle $\alpha$ of approx. 35° towards one another and are substantially arranged circularly. Microphones 6*a*, 6*b* are attached to the separating surfaces 5*a*, 5*b* which are provided with substantially omnidirectional pick-up characteristics. The distance d of the microphones 6*a*, 6*b* from the separating surfaces 5*a*, 5*b* is small as compared with the wavelengths of the sound, e.g. 3 mm. As can be seen from FIG. 1, microphones 6*a*, 6*b* are arranged outside of the mid-points $M_a$, $M_b$ of the separating surfaces 5*a*, 5*b*, namely in a region towards the wider end of the separating body. This means that the microphones are attached to points of the separating surfaces 5*a*, 5*b* whose distance f is larger than the distance g of the mid-points $M_a$, $M_b$ of the separating surfaces 5*a*, 5*b*. Preferably, the distance h of the microphones 6*a*, 6*b* from the central point $M_a$, $M_b$ of the separating surfaces 5*a*, 5*b* is approx. 20% of the diameter e of the separating surfaces 5*a*, 5*b*. It is favorable to provide the place of attachment of the microphones 6*a*, 6*b* also outside of a horizontal plane 7 which is simultaneously the plane of symmetry of the apparatus. In practice, the diameter e is assumed with approx. 25 cm.

The two separating surfaces 5*a*, 5*b* are connected by a cylindrical surface 8 whose thickness increases from the front side with 6 cm to 20 cm at the rear side.

What is claimed is:

1. An apparatus for picking up sound waves with a wedge-shaped separating body which consists of a reverberant material and at least two microphones arranged on the separating body, said separating body having two separating surfaces which are inclined towards one another and at an acute angle, wherein the microphones are arranged at a low distance from the separating surfaces.

2. An apparatus according to claim 1, wherein the separating surfaces even.

3. An apparatus according to claim 1, wherein the acute angle in which the separating surfaces are inclined towards one another is between 10° and 50°.

4. An apparatus according to claim 1, wherein the acute angle in which the separating surfaces are inclined towards one another is between 25° and 40°.

5. An apparatus according to claim 1, wherein the separating surfaces have the form of circles.

6. An apparatus according to claim 5, wherein the diameter of the separating surfaces is between 20 cm and 35 cm.

7. An apparatus according to claim 5, wherein the distance of the separating surfaces at the points of closest approach is between 10% and 30% of the diameter of the separating surfaces.

8. An apparatus according to claim 5, wherein the separating surfaces are provided with an integral arrangement with a circular-cylindrical housing which is rounded off in the transition zone into the separating surfaces.

9. An apparatus according to claim 5, wherein the microphones are arranged outside of the mid-points of the separating surfaces.

10. An apparatus according to claim 5, wherein the microphones are attached to points of the separating surfaces which are provided with a larger distance than the mid-points of the separating surfaces.

11. An apparatus according to claim 10, wherein the separating surfaces are provided with a circular arrangement and that the microphones are arranged at a distance from the mid-point of the separating surfaces which is between 10% and 50%, of the diameter of the separating surfaces.

12. An apparatus according to claim 11, wherein the microphones have omnidirectional characteristics.

13. An apparatus according to claim 10, wherein the separating surfaces are provided with a circular arrangement and that the microphones are arranged at a distance from the mid-point of the separating surfaces which are between 20% and 40%, of the diameter of the separating surfaces.

14. An apparatus according to claim 13, wherein the microphones have omnidirectional characteristics.

15. An apparatus according to claim 1, wherein the apparatus is arranged as a shell body which is hollow in the interior.

* * * * *